US005909953A

United States Patent [19]

Shima

[11] Patent Number: 5,909,953

[45] Date of Patent: Jun. 8, 1999

[54] FLUORESCENT LIGHTING FIXTURE

[75] Inventor: Kensuke Shima, Nara, Japan

[73] Assignee: Jefcom Co., Ltd., Osaka, Japan

[21] Appl. No.: 08/857,106

[22] Filed: May 15, 1997

[30] Foreign Application Priority Data

May 17, 1996 [JP] Japan ..... 8-123792

[51] Int. Cl.[6] ..... F21K 2/00

[52] U.S. Cl. ..... 362/260; 362/222; 362/376

[58] Field of Search ..... 362/222, 223, 362/260, 376, 399, 334, 340

[56] References Cited

U.S. PATENT DOCUMENTS 2,874,270 2/1959 Douglass et al. ..... 362/222

3,136,489 6/1964 Oharenko ..... 362/222

*Primary Examiner*—Stephen Husar

*Attorney, Agent, or Firm*—Koda & Androlia

[57] ABSTRACT

The fluorescent lighting fixture includes a protective tube having a roulette configuration dented portions of which extend longitudinally and a rib having a long hole in which a wire is inserted. The roulette configuration appears as a stripe pattern on the protective tube and the wire inserted in the hole becomes less noticeable. When the fluorescent lamp is set alight, the light reflects, the entire protective tube becomes luminous uniformly, and the wire becomes hard to be seen. The wire can be invisible without an extra part such as a screening plate, and sufficient luminous intensity can be obtained from the entire protective tube.

5 Claims, 7 Drawing Sheets

FLUORESCENT LIGHTING FIXTURE

BACKGROUND OF THE INVENTION

The present invention relates to a fluorescent lighting fixture used in construction sites of buildings, engineering sites of tunnels or subways, factories of automobile maintenance and repair, and the like.

In a known fluorescent lighting fixture of this type using a straight fluorescent lamp, terminals at both ends of the lamp must be connected with two electric wires. The wires extend parallel to the straight fluorescent lamp. In order not to show the wires, as shown in FIGS. 6, 7, a slender screening plate 11 is provided in a gap between the fluorescent lamp 1 and a protective tube 2 for the lamp 1 to hide the electric wires 6.

In the above known fluorescent lighting fixture, since the slender screening plate 11 is inserted in the gap between the fluorescent lamp 1 and the protective tube 2, when the lamp 1 is lit, the screening plate 11 casts its shadow and the entire periphery of the fixture does not become luminous. Consequently, the sufficient luminous intensity (brightness) cannot be obtained.

The above known fluorescent lighting fixture requires the above mentioned screening plate 11 to be inserted in the gap between the fluorescent lamp 1 and the protective tube 2, which causes to increase the number of parts of the fixture. As a result, an extra cost for materials involves and is responsible for a higher production cost.

OBJECTS AND SUMMARY OF THE INVENTION

It is therefore an object of the present invention to provide a fluorescent lighting fixture which solves the above problems, and makes the wires 6 less noticeable without using the slender screening plate 11 in the gap between the fluorescent lamp 1 and the protective tube 2.

The fluorescent lighting fixture of the present invention includes a roulette configuration 5, or a knurling, dented portions of which extend longitudinally on a protective tube 2 for a fluorescent lamp 1, and a rib 8 having a long hole 7 in which a wire 6 is inserted.

The roulette configuration 5 is preferably formed on the inner face of the protective tube 2. It may be provided on its entire circumference.

Furthermore, the rib 8 may have a longitudinal slit 7*a* which merges into the long hole 7. A wire 6 to be inserted into the hole 7 may be a naked electric wire.

Due to the roulette configuration 5, or a knurled face, dented portions of which extend longitudinally on the protective tube 2, a pattern with a number of stripes appears on the protecting tube 2. Therefore in the fluorescent lighting fixture of the present invention, the wire 6 inserted in the long hole 7 becomes less noticeable. When the fluorescent lamp 1 is set alight, light reflects and the protective tube 2 becomes luminous, which makes the wire 6 hard to be seen.

The roulette configuration 5 being provided on the inner face of the protective tube 2, the outside of the tube 2 may be kept smooth. When the outside of tube 2 becomes dirty, it may be cleaned simply by wiping.

Furthermore, the protective tube 2 having a slit 7*a* which merges into the long hole 7 is easy to be taken out from a mold in synthetic resin forming process.

Additionally, when a naked electric wire is used as a wire 6 to be inserted in the long hole 7, the diameter of the hole 7 can be reduced, and the reduced diameter thereof allows the projecting part of the rib 8 from the protective tube 2 to be smaller.

The above and other objects, features and advantages of the present invention will become apparent from the following description in conjunction with the accompanying drawings.

BRIEF DESCRIPTION OF THE DRAWINGSE

DESCRIPTION OF THE PREFERRED EXAMPLES

Figure 1:
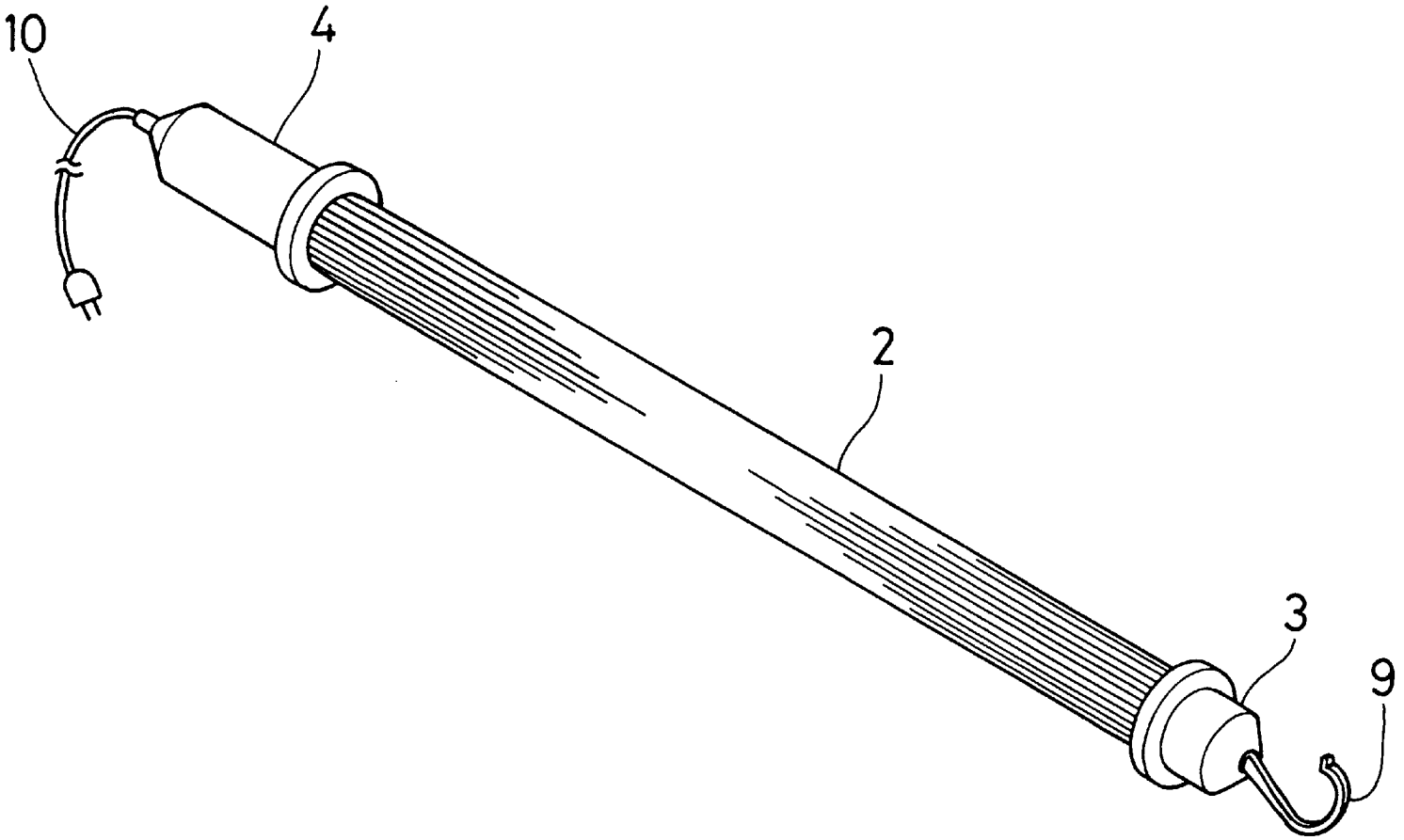
FIG. 1 is a perspective view showing a fluorescent lighting fixture of the present invention.

FIG. 1 shows one example of the fluorescent lighting fixture of the present invention. A protective tube 2 houses a fluorescent lamp 1 and is provided with a closing member 3 at one open end and a gripping member 4 at the other open end.

Figure 2:
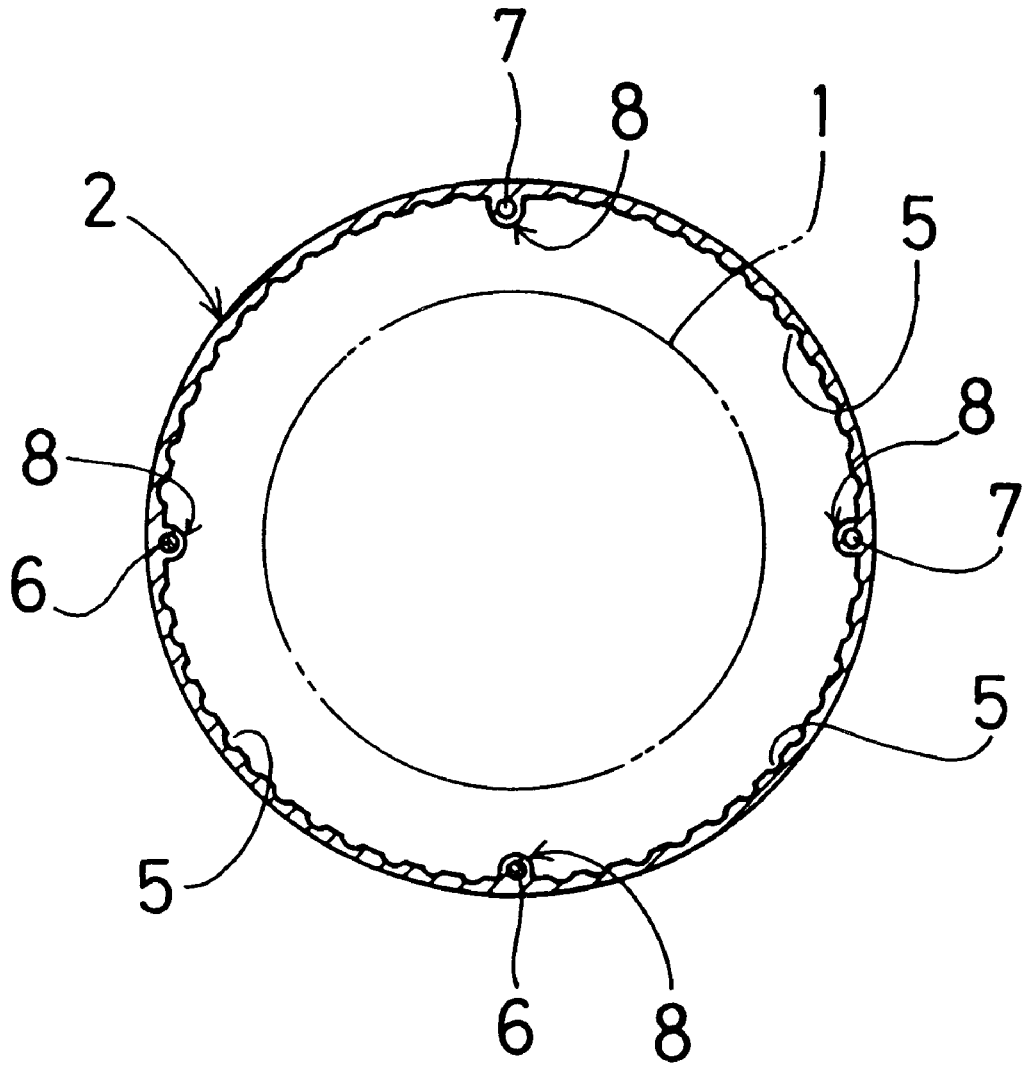
FIG. 2 is a sectional view of the protective tube of the fluorescent lighting fixture of the present invention.
Figure 3:
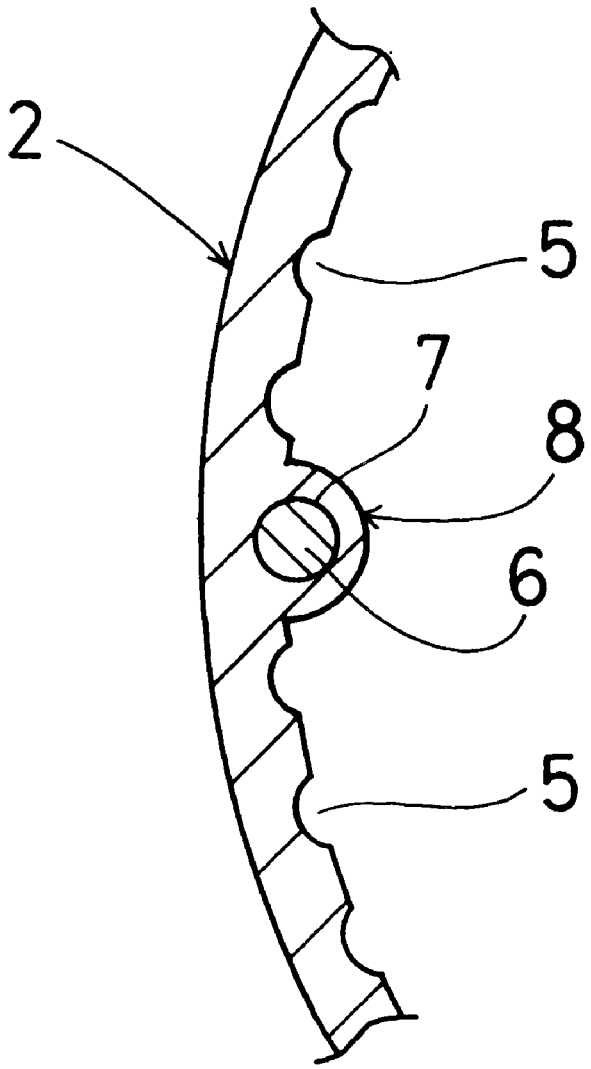
FIG. 3 is a partially enlarged sectional view of the protective tube of the fluorescent lighting fixture shown in FIG. 2.
Figure 4:
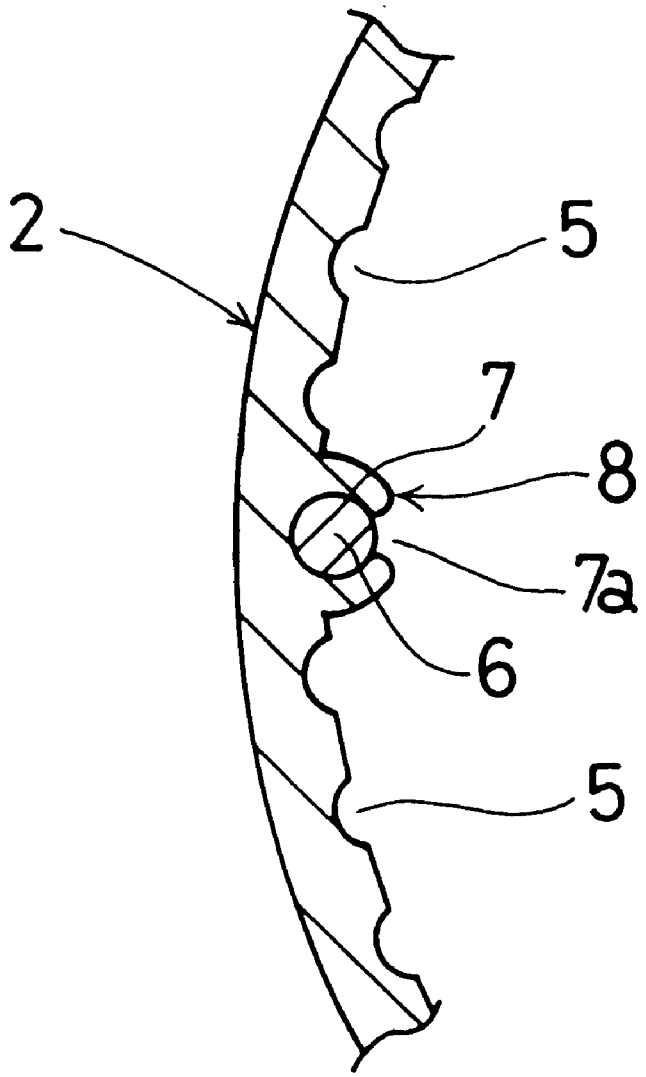
FIG. 4 is a partially enlarged sectional view of another protective tube of the fluorescent lighting fixture of the present invention.
Figure 5:
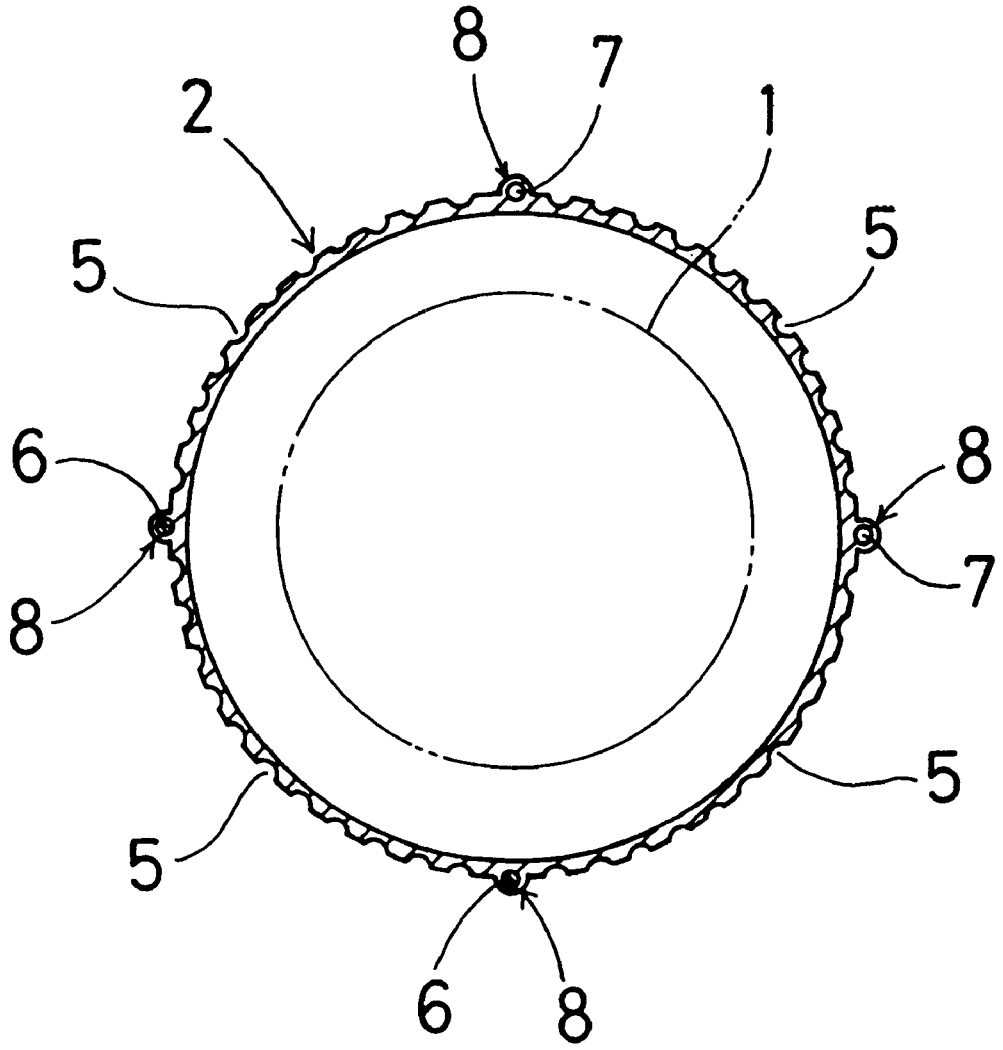
FIG. 5 is a sectional view of another protective tube of the fluorescent lighting fixture of the present invention.
Figure 6:
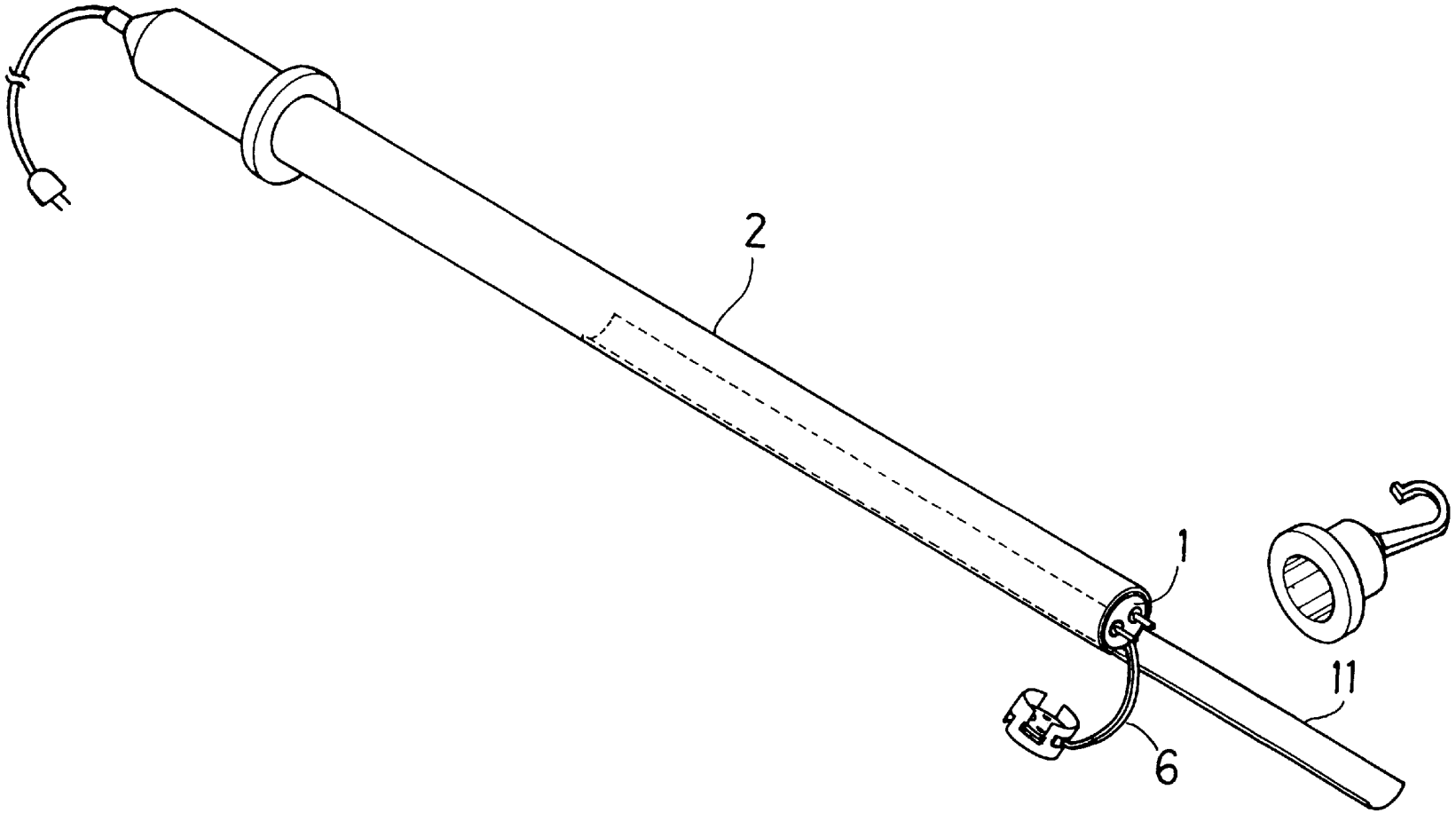
FIG. 6 PRIOR ART
FIG. 6 is a perspective view of a known fluorescent lighting fixture.
Figure 7:
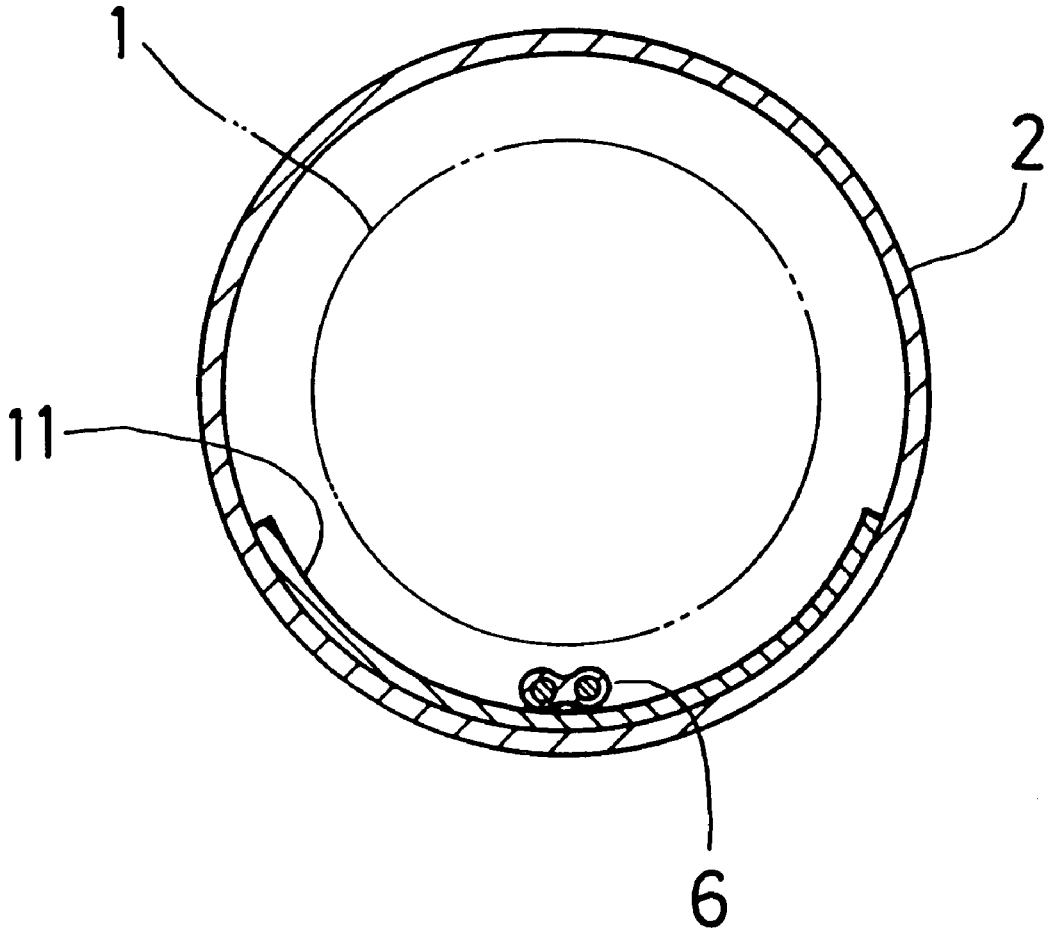
FIG. 7 PRIOR ART
FIG. 7 is a sectional view of a protecting tube of a known fluorescent lighting fixture.

The protective tube 2 is made of translucent synthetic resin. FIG. 2 shows a protective tube 2 which is a cylindrical tube with a circle in section. But the shape of the tube 2 is not limited thereto, and it may be an ellipse, an oval, a polygon or the like in section. The protective tube 2, as shown in FIG. 2, has a roulette configuration 5 or a knurling on the entire inner circumference and dented portions of it extend longitudinally. At a suitable circumferential point is provided a rib 8 which extends longitudinally and has a long hole 7 therein in which a wire 6 is to be inserted. A longitudinal slit 7*a* merging into the long hole 7 may be provided as occasional demands, as shown in FIG. 4. It allows an easy ripping from the mold in plastic forming process. The roulette configuration 5 may be provided on the outer face of the protective tube 2 as shown in FIG. 5. In this case, the rib 8 is also provided on the outer face of the protective tube 2, but it may be separately provided on the inner face of the tube 2. The roulette configuration 5 may be provided only in the vicinity of the rib 8, instead of on the entire circumference.

The closing member 3 is inserted into one end of the protective tube 2 to seal its open end. And a hanging member 9 may be projected on the closing member 3, so that the lighting fixture can be used in a suspended state.

The gripping member 4 is inserted into the other end of the protective tube 2 to seal its open end. An electric cord 10 is brought into the inside of the gripping member 4. In the space within the gripping member 4 is provided a ballast and the like.

The roulette configuration 5 has a section of a series of semi-circular dents and the dented portions extends longitudinally to form a stripe pattern. The shape of the section is not limitative thereto, and various shapes such as a series of triangular notches can be applied to it. In the tube with a section of a series of semi-circular dents, when the diameter of the semi-circle is set substantially equal to that of the long hole 7, the angles of reflection of light are unified and the protective tube 2 as a whole becomes luminous uniformly, and thereby the wire 6 becomes more effectively invisible.

The wire 6 may be covered with insulating material such as rubber. When the wire is inserted in the hole 7 of the rib 8, the rib 8 serves as an insulator, so that a naked electric wire can be used. In use of a naked electric wire, the diameter of the long hole 7 can be reduced and this allows the projecting part of the rib 8 from the protective tube 2 to be reduced.

It is advisable that the long hole 7 of the rib 8 has the same diameter as that of the wire 6 and the wire 6 can be inserted straight. In this example, four ribs 8 are provided at equal intervals. Two wires 6 are selectively inserted in any two of four long holes 7 in the ribs 8.

The fluorescent lighting fixture of the present invention has a roulette configuration 5 on the protective tube 2, dent portions of which extend longitudinally. Therefore a pattern of plural stripes appears on the protective tube 2, which makes the wire 6 inserted in the long hole 7 less noticeable. When the fluorescent lamp 1 is lit, the reflection of light makes the entire protective tube 2 luminous, which causes the wire 6 hard to be seen. Namely, the slender screening plate 11, which is required in the gap between the fluorescent lamp 1 and the protective tube 2 for the foregoing known lighting fixture, becomes unnecessary. There is no need to increase the number of parts for the fixture in order to hide the wire and the production cost can be kept at a lower level.

Since the fluorescent lighting fixture of the present invention has no slender screening plate 11 in the gap between the fluorescent lamp 1 and the protective tube 2, when the fluorescent lamp 1 is set alight, there is no shadow of the plate 11 and the entire light fixture becomes effectively luminous. As a result, sufficient luminous intensity can be secured.

What is claimed is:

1. A fluorescent lighting fixture comprising:

a fluorescent lamp;

two electric wires connected to said lamp;

a protective tube surrounding said lamp, said protective tube being provided with a roulette configuration extending longitudinally on said protective tube; and at least two longitudinal ribs provided on said protective tube, said at least two longitudinal ribs having respective long holes therein through which said two electric wires are respectively inserted.

2. A fluorescent lighting fixture according to claim 1, wherein said roulette configuration is provided on an inner face of said protective tube.

3. A fluorescent lighting fixture according to claim 1, wherein said roulette configuration is provided on an entire circumference on said protective tube.

4. A fluorescent lighting fixture according to claim 1, further comprising at least two longitudinal slits provided in respective said longitudinal ribs which merge into said at least two long holes.

5. A fluorescent lighting fixture according to claim 1, wherein said wires are naked electric wires.

* * * * *